US005651309A

United States Patent [19]

Motev

[11] Patent Number: 5,651,309

[45] Date of Patent: Jul. 29, 1997

[54] PEEL CONTROL MEANS FOR OFF-CONTACT SCREEN PRINTING PRESS

[75] Inventor: Phil Motev, Deerfield, Ill.

[73] Assignee: A.W.T. World Trade, Inc., Chicago, Ill.

[21] Appl. No.: 547,497

[22] Filed: Oct. 24, 1995

[51] Int. Cl.[6] ..... B41F 15/42

[52] U.S. Cl. ..... 101/123; 101/129

[58] Field of Search ..... 101/114, 123, 101/124, 127.1, 129

[56] References Cited

U.S. PATENT DOCUMENTS

| | | | |
|---|---|---|---|
| 3,731,623 | 5/1973 | Bubley et al. | 101/123 |
| 3,859,917 | 1/1975 | Bubley et al. | 101/123 |
| 3,955,501 | 5/1976 | Bubley et al. | 101/123 |
| 4,254,707 | 3/1981 | Lambert et al. | 101/127.1 |
| 4,537,126 | 8/1985 | Bubley | 101/123 |
| 5,265,531 | 11/1993 | Cronin | 101/123 |

*Primary Examiner*—Stephen R. Funk

*Attorney, Agent, or Firm*—Silverman, Cass & Singer, Ltd.

[57] ABSTRACT

Peel control for an off-contact printing press. The peel control includes a clutch and a linkage assembly synchronized in its peeling action in a printing stroke with a conventional carriage assembly mounting the squeegee and flood bar. In the printing stroke, the clutch is engaged to effect pivot of the master frame relative to the horizontal printing bed of the press and synchronized with the carriage assembly movement to effect peeling of the print screen in such a print stroke. Upon completion of the print stroke, the clutch is disengaged to permit return of the master frame to its horizontal position relative to the print bed. Thereafter, the flood bar is moved in its flood stroke across the print screen, which will be in a horizontal position relative to the print bed also, to the initial position for the succeeding print stroke.

6 Claims, 4 Drawing Sheets

PEEL CONTROL MEANS FOR OFF-CONTACT SCREEN PRINTING PRESS

This invention relates generally to screen printing machines and more particularly to novel peel control means for use in a screen printing machine adapted for off-contact printing.

The conventional screen printing press performs a printing cycle in a two-step procedure. A pool of printing ink is pushed by a so-called "flood bar" across the screen toward one end of the screen, in a so-called "flood stroke." The screen is placed immediately on top of the substrate to be printed, the flood bar is withdrawn and a squeegee bar is lowered into contact with the screen. The squeegee bar is then drawn in the opposite direction across the screen to force the ink through prescribed areas for making an imprint on the substrate. In this printing cycle, the print screen remains horizontal on the printing bed of the machine both in the printing stroke and flood stroke.

For off-contact printing, the appreciable stretch of the screen material is taken into consideration. In this type of printing, the print screen is peeled or lifted behind the squeegee as the squeegee is moved across the screen in the print stroke. Upon completing the print stroke, the squeegee is withdrawn and the flood bar is brought into desired position relative to the screen to push a pool of printing ink across the screen in the flood stroke in the opposite direction to the initial position of the squeegee for a successive printing stroke. As the flood stroke is performed, the print screen is gradually lowered to its normal horizontal position on the printing bed of the machine. The withdrawal of the imprinted substrate and replacement with a fresh substrate is performed in a conventional manner synchronized with the printing and flood strokes of the printing cycle.

Screen printing machines have been developed which include a carriage on which are mounted a squeegee assembly and a flood bar assembly. The carriage is driven across the screen in the print stroke and reversed in direction across the screen in the flood stroke to perform a complete printing cycle. U.S. Pat. No. 3,955,501 issued May 11, 1976 discloses a conventional screen printing machine having a carriage assembly for time and controlled movement of the squeegee and flood bar across a print screen for a printing cycle. This patent teaches a machine having a printing bed for holding a print screen in horizontal position both during the print and flood strokes and the provision of a driven carriage assembly which can actuate the squeegee and flood bar carried by the carriage assembly for completing a printing cycle.

This patent also discloses a screen printing machine having means for lifting or peeling the print screen behind the squeegee as the squeegee is moved through its print stroke. U.S. Pat. No. 3,731,623 discloses a screen printing machine which has peeling means which raises the screen from the substrate surface being printed immediately behind the squeegee for off contact printing. Further, the patent discloses a carriage assembly for the squeegee and flood bar for controlling movement of the squeegee and flood bar relative to the print screen in a complete printing cycle.

SUMMARY OF THE INVENTION

The present invention comprises peel control means which includes a clutch-type means and a linkage arrangement engaged during the printing stroke to pivot one end of the printing screen gradually from a horizontal or zero position relative to the printing bed of the printing press to an angular position relative to the printing bed upon completion of the printing stroke. Upon completion of the printing stroke, the clutch-type means automatically is disengaged to permit the printing screen to be pivoted to its horizontal or zero position before commencement of the flood stroke. The flood stroke then is performed to complete the printing cycle, thus preparing the press for a succeeding printing cycle.

The printing press with which the peel control means embodying the invention is operative will utilize a conventional printing bed and master frame for the screen and a carriage assembly for the squeegee and flood bar and conventional drive means connected to the carriage means for actuating the carriage and its associated squeegee and flood bar in completing a printing cycle. The drive means has the peel control means embodying the invention connected therewith.

DESCRIPTION OF PREFERRED EMBODIMENT

Figure 1:
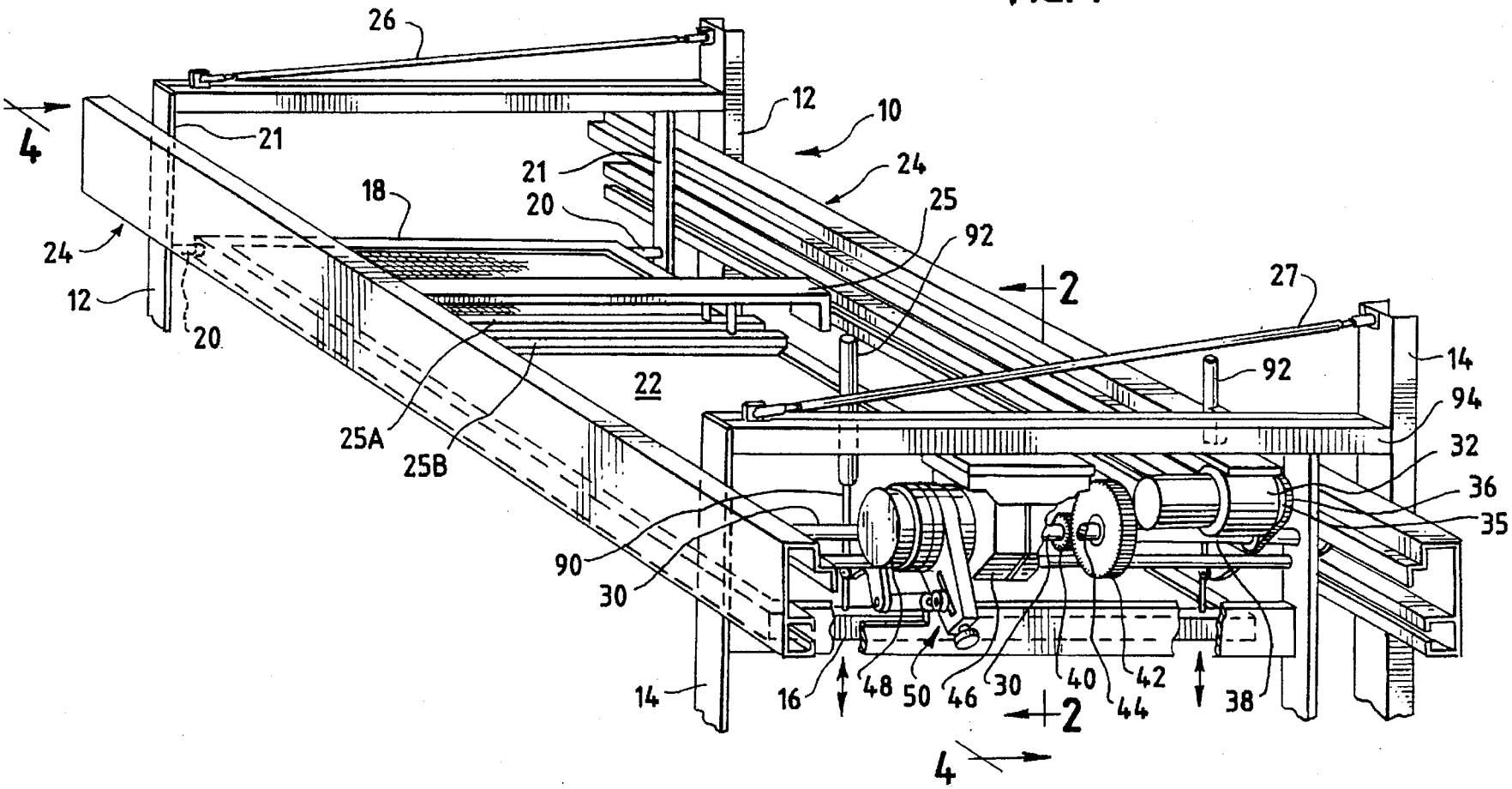
FIG. 1 is a fragmentary perspective view of a printing press in which the novel peel control means embodying the invention have been installed and showing the printing screen in the lowered or printing position and portions broken away to show details.

Referring to FIG. 1, the reference character 10 identifies a screen printing press configured for off-contact printing. The press as identified by reference character 10 does not show a conventional carriage assembly, such as identified by reference character 22 in U.S. Pat. No. 3,955,501 which carries a squeegee assembly 70 and doctor blade 72. However, in accordance with the herein invention, the press 10 will utilize a carriage assembly illustrated diagrammatically and operative in a manner which will be explained in detail subsequently herein.

The press 10 has a head or frame 12 at its distal end and a head or frame 14 at its opposite end between which the operative components of the press 10 are supported. A master frame or chase 16 is pivotally secured at one end 18 thereof on the rod 20 secured between the standards 21 of head 12. The printing bed for the press which normally would be installed below the master frame to support the substrate to be imprinted is not shown, but it will be understood that press 10 will have such a printing bed. The master frame will mount the print screen 22 on which surface areas will be specially prepared to permit printing ink to be passed therethrough during passage of the squeegee in the print stroke for creating the desired image on the substrate. This procedure is conventional in this field or art.

Supported on the heads 12 and 14 and extending the length of the press 10 are the pair of opposing spaced apart tracks 24 for the carriage assembly shown diagrammatically at 25. The carriage 25 carries a squeegee bar 25A and a flood bar 25B. Also shown in FIG. 1 are the tension bars 26 and 27 installed on the heads 12 and 14 respectively.

Figure 2:
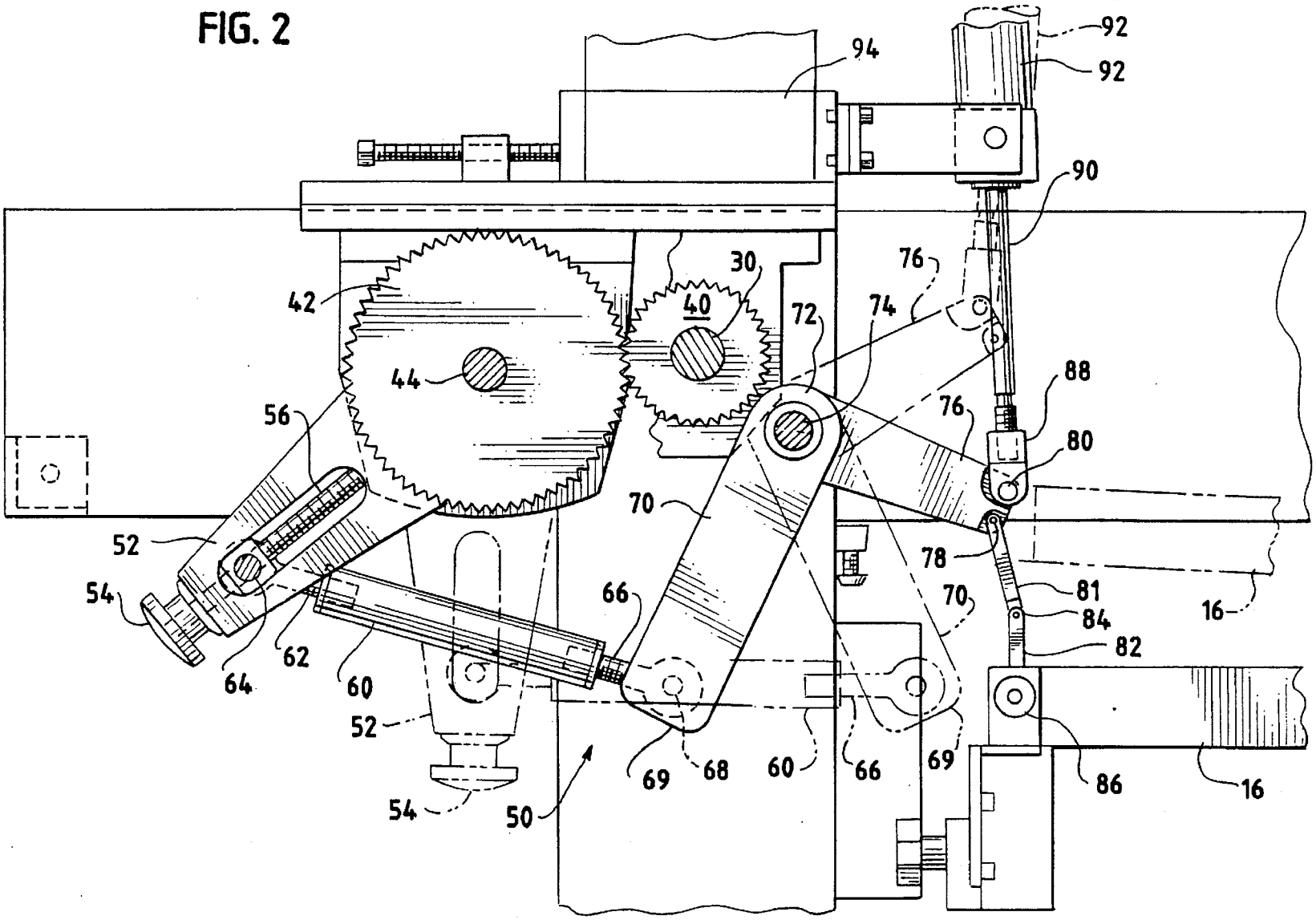
FIG. 2 is a sectional view taken through the machine along the line 2—2 of FIG. 1 and in the general direction shown.

Referring to FIGS. 1 and 2, drive shaft 30 is driven by the motor 32. The carriage assembly 25 is connected by means of the pulleys 34 at opposite ends of the shaft 30 and which include conventional pulley belts (not shown) connected for moving the carriage assembly 25 in a timed printing cycle along the tracks 24.

The motor 32 connects to a drive pulley 35 carrying a sprocket chain 36 which drives a gear 38 mounted on the drive shaft 30. As seen in FIG. 1, drive shaft 30 mounts medially a small diameter gear 40 which is meshed with the larger diameter gear 42 supported on the shaft 44. Connecting with the gear 42 on shaft 44 is a gear reducer unit 46 operatively connected to a clutch assembly 48. To the clutch assembly 48 is connected a linkage assembly designated generally 50. Operable for adjusting the rotary speed of the larger diameter gear 42 relative to the smaller diameter gear 40 is a peel adjustment assembly 52 operated by means of the knob 54 which connects to the threaded shank 56 by means of which the gear adjustment ratio between the gears 40 and 42 can be accomplished.

Referring to FIG. 2, the linkage assembly 50 includes a first link 60 connected at one end 62 to the peel adjustment assembly 52 at 64. The opposite end 66 of link 60 is connected to the pivot 68 provided at the lower end 69 of the link 70. The opposite upper end 72 of link 70 has a pivot 74 to which is pivotally connected at one end the link 76. The opposite end 77 of link 76 has a pair of pivots 78 and 80. To the pivot 78 is connected a pair of links 81 and 82 joined at the intermediate connection 84. The link 82, in turn, is secured to the master frame 16 through the connector member 86. The link 82 connects to the master frame at its end 89 opposite its pivoted end 18.

Figure 3:
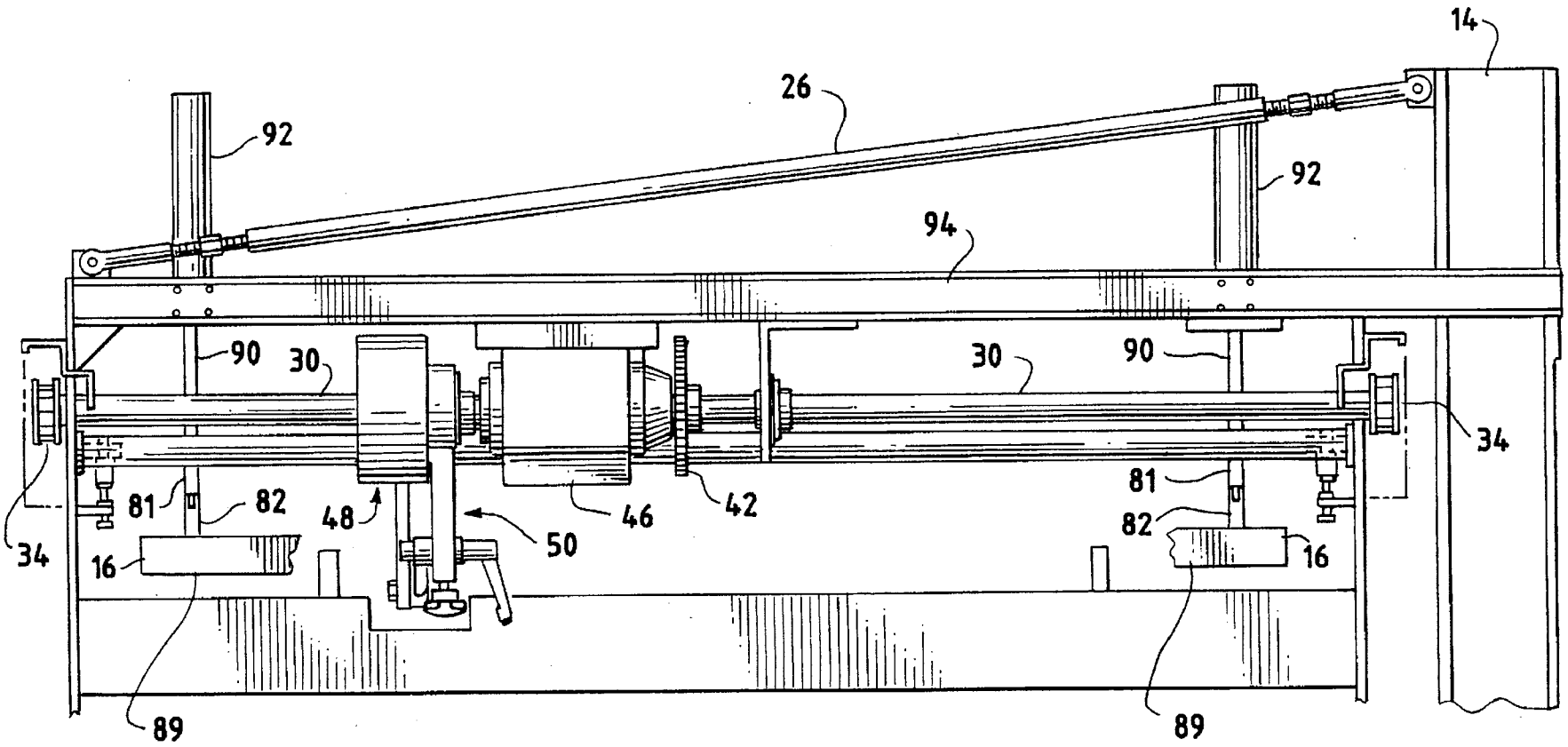
FIG. 3 is a flagmentary end view of the printing press of FIG. 1.

The second pivot 80 is pivotally connected to the fixture 88 which is threadedly engaged to the rod member 90 operated through the cylinder 92. The cylinder 92 is secured on the cross bar 94 of the head 14. Referring to FIG. 3, it will be seen that a pair of cylinders 92 are secured on the cross bar 94 spaced apart laterally. Each of the cylinders 92 has the rod members 90 connected to a link member 76 at a pivot 80 which in turn is connected to similar link members 81 and 82 which, in turn, are connected in proximity to a lateral edge of the master frame 16 as depicted in FIGS. 1 and 3.

As viewed in FIG. 1, the master frame 16 is in its normal horizontal or zero angular position relative to the printing bed on which the substrate to be imprinted through the screen 22 will be positioned. As shown in solid outline in FIG. 2, the master frame is in the same position. The clutch 48 will be disengaged when the master frame is in such a horizontal position prepared for the printing stroke.

For the print stroke, the carriage 25 mounting the squeegee and flood bar assemblies will be activated by suitable controls (not shown) and the clutch assembly 48 will be engaged so that the carriage and clutch assembly are synchronized in performing their respective functions. The printing screen will have been flooded with printing ink in preparation for performing the printing stroke and the squeegee lowered into contact with the printing screen. Upon forward movement of the carriage 25 toward the pivoted end 18 of the master frame, engagement of the clutch 48 will effect movement of member 52 and link 60 to the right as seen in broken outline in FIG. 2. Link 70 will pivot at 74 to pivot link 76 vertically thereby moving the rod 90 upwardly. This movement will be translated through links 81 and 82 to raise the master frame 16 concurrently with movement of the carriage 25 along the tracks 24 toward end 18 of the master frame. The movement of the squeegee in its print stroke will be accompanied by synchronous lifting movement of the master frame to achieve peeling of the screen during the printing stroke.

Upon completion of the printing stroke, the printed substrate is withdrawn from the printing bed and the clutch 48 is disengaged, which causes the plungers 90 to be released so that the master frame 16 will drop to its original horizontal position as shown in FIGS. 1 and 2. The squeegee is lifted from the screen 22 and the flood bar is lowered to position for flooding the screen 22 in its flood stroke when the carriage is returned to its desired position in proximity to the head 14 for repeating the printing stroke.

Figure 4A:
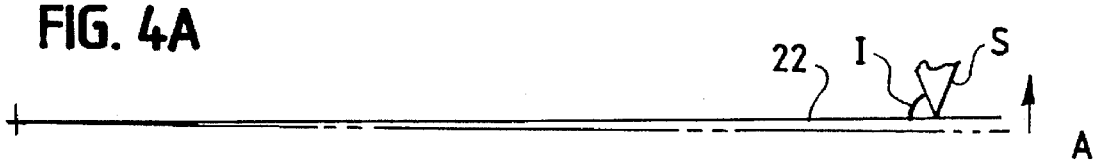
FIGS. 4A–4F are diagrammatical views illustrating the sequence of the printing stroke and flood stroke of a printing cycle by the clutch control means embodying the invention. The views are depicted along the line 4—4 of FIG. 1 and in the direction indicated generally.
Figure 4B:
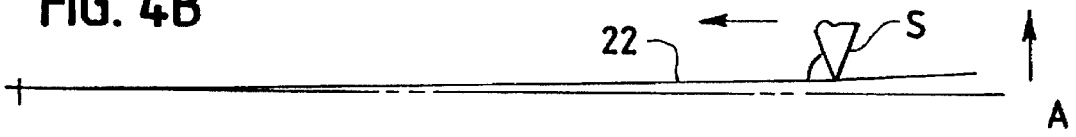
Figure 4C:
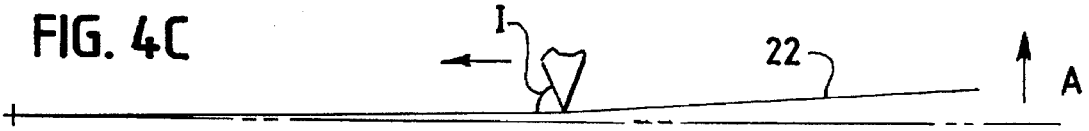
Figure 4D:
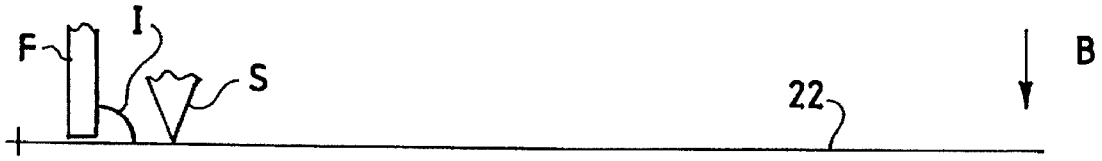
Figure 4E:
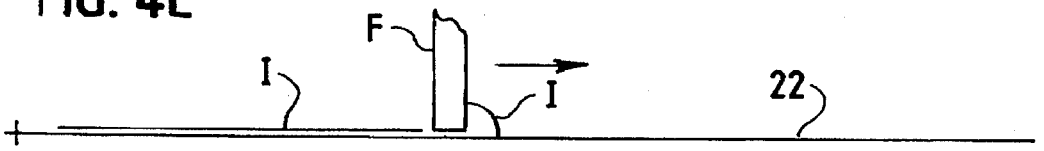
Figure 4F:
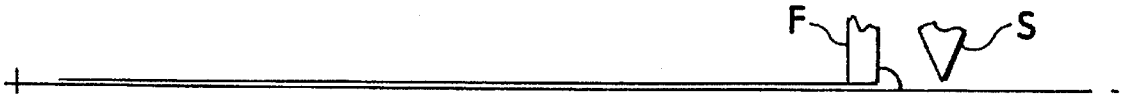

A printing cycle is depicted in the diagrams comprising FIGS. 4A–4F. FIGS. 4A, 4B and 4C illustrate the printing stroke progressively. The commencement of the printing stroke is shown in FIG. 4A. As the squeegee S is moved to the left, the flexibility of the screen 22 will enable the squeegee to press printing ink through delineated areas onto the substrate (not shown). The arrows A illustrate peeling action from horizontal position of the printing bed during the printing stroke. Completion of the printing stroke is shown in FIG. 4D. The squeegee will then be withdrawn and the flood bar F will be lowered to a position for flooding the screen 22 which is now in a horizontal position since the clutch 48 will have been disengaged to drop the master frame depicted by the arrow B. The flood stroke is shown in process in FIG. 4E and completed in FIG. 4F. The spread of ink I is shown as the flood bar moves across the screen 22.

To repeat the printing stroke, the flood bar will be withdrawn, and the squeegee lowered into contact with the screen 22. Although automatic control means have not been described and illustrated, this technology is known in the art and therefore deemed unnecessary to describe and illustrate in detail in order to understand the herein invention which is concerned with the control means for performing the peeling function in off-contact printing.

In its essence, the herein invention departs from the prior methodology of off-contact printing in which the flood stroke was performed concurrently with lowering the master frame gradually to its horizontal position relative to the printing bed after the printing stroke was completed. The herein invention provides methodology which effects lowering the master frame to its horizontal position after the print stroke and prior to the flood stroke. The methodology is accomplished by means of a novel combination clutch and linkage assembly operatively connected to the end of the master frame opposite its pivotal end. This methodology is understood to be performed synchronized with operation of a conventional carriage assembly mounting a squeegee and flood bar which controls the sequential functions of the squeegee and flood bar in a printing cycle. It is well known in this art to provide control systems for coordinating the sequential movements of such performing apparatus in a screen printing press. Such a control system per se for coordinating the movements of the novel combination clutch and linkage assembly embodying the invention with carriage assembly movement is deemed within the ordinary skill of personnel in this art and can be accomplished with many different kinds of electrical and/or hydraulic circuitry.

I claim:

1. In an off-contact screen printing press having a print bed, a master frame, a print screen supported in said master frame and a carriage assembly mounting a squeegee and flood bar, said carriage assembly being mounted for reciprocal movement between opposite ends of the master frame for completing a printing cycle of the press, said master frame being pivotally mounted at a distal end thereof on the press normally in a horizontal plane relative to the printing bed; the herein invention comprising peel control means connected to said master frame for selectively pivoting said master frame during a complete printing cycle, said peel control means including a driven shaft, clutch means assembled to said shaft and a linkage assembly operable with said clutch means and connected to an end of the master frame opposite said distal end, the movement of said carriage assembly mounting said squeegee and flood bar being synchronized with said clutch assembly and linkage assembly during a complete printing cycle in which the master frame is pivoted relative to the printing bed during the print stroke and returned to its normal horizontal plane prior to commencement of the flood stroke.

2. The invention according to claim 1 in which said peel control means include a gear reducer assembly and a peel adjustment assembly.

3. The invention according to claim 1 in which said linkage assembly includes link members and a cylinder having a plunger rod connected to the master frame, said plunger rod being actuated by said link members of the linkage assembly to pivot the master frame during the print stroke and release the master frame by disengagement of said clutch means for return to its normal horizontal plane after completion of the print stroke and prior to start of the flood stroke.

4. The invention according to claim 1 including a pair of meshed gears of different diameters connected to said driven shaft, said driven shaft being operative to drive said pair of meshed gears, a gear reducer assembly connected to the gear having the larger diameter, said larger diameter gear being connected to said clutch means and linkage assembly for effecting pivotal movement of the master frame.

5. The invention according to claim 4 which includes a peel adjustment assembly operatively connected to said larger diameter gear, said smaller diameter gear being mounted on the driven shaft.

6. In a method of off-contact screen printing on a screen printing press having a print bed, a master frame, a print screen supported in said master frame and a carriage assembly mounting a squeegee and flood bar, said carriage assembly being mounted for reciprocal movement between opposite ends of the master frame for completing a printing cycle of the press, said master frame being pivotally mounted at a distal end thereof on the press normally in a horizontal plane relative to the print bed, the herein invention comprising the step of interrupting the printing cycle to drop the master frame to a horizontal position relative to the print bed after completion of the print stroke and prior to commencement of the flood stroke.

* * * * *